US006659276B2

(12) United States Patent
Anderson et al.

(10) Patent No.: US 6,659,276 B2
(45) Date of Patent: Dec. 9, 2003

(54) TWO-DOOR CHAINSAW CASE WITH SEPARATE SCABBARD

(75) Inventors: Jeffrey S. Anderson, Clinton, IA (US); Patrick T. Jones, Fulton, IL (US); Ronald A. Zimmer, DeWitt, IA (US); James M. Wiese, Clinton, IA (US)

(73) Assignee: Custom-Pak, Inc., Clinton, IA (US)

( * ) Notice: Subject to any disclaimer, the term of this patent is extended or adjusted under 35 U.S.C. 154(b) by 7 days.

(21) Appl. No.: 10/002,679

(22) Filed: Oct. 24, 2001

(65) Prior Publication Data

US 2003/0075467 A1 Apr. 24, 2003

(51) Int. Cl.[7] ..... A45C 11/26; B65D 85/00; B65D 1/22; B65D 5/00

(52) U.S. Cl. ..... 206/349; 206/745; 206/766; 206/320

(58) Field of Search ..... 206/349, 745, 206/766, 822, 774, 736, 320; D9/420–429; D3/905; 190/16; 224/404

(56) References Cited

U.S. PATENT DOCUMENTS 4,371,079 A * 2/1983 Dembicks ..... 206/349

D431,108 S * 9/2000 Lewis et al. ..... D3/276

FOREIGN PATENT DOCUMENTS

| | | | | |
|---|---|---|---|---|
| DE | 19648043 A1 * | 5/1998 | ..... | B65D/85/68 |
| EP | 273808 A1 * | 7/1988 | ..... | B65D/85/00 |
| FR | 2589339 A1 * | 5/1987 | ..... | A45F/3/00 |

* cited by examiner

*Primary Examiner*—Mickey Yu
*Assistant Examiner*—John G. Pickett
(74) *Attorney, Agent, or Firm*—St. Onge, Steward Johnston & Reens LLC

(57) ABSTRACT

A chainsaw case for a chainsaw having a bar is provided. The case includes a base having a lower, a rear, and two end walls, one of the end walls having a slot therein. A front member is pivotally connected to the base and is pivotable from a closed position toward a position in which the front member is substantially coplanar with the lower wall. A top member is pivotally connected to the base about a pivot axis which is substantially parallel to the pivot axis of the front member, and is pivotable from a closed position toward a position in which the top member is substantially coplanar with the rear wall. The case also includes a scabbard for being applied to the bar of the chainsaw, the scabbard having an end portion adapted to be received within the slot when the chainsaw is disposed within the base.

23 Claims, 7 Drawing Sheets

TWO-DOOR CHAINSAW CASE WITH SEPARATE SCABBARD

FIELD OF THE INVENTION

The present invention relates to a carrying case for a chainsaw, and more particularly to such a carrying case which includes at least two pivotally openable doors and a separate scabbard.

BACKGROUND OF THE INVENTION

Double wall blow molded carrying cases have been used as reusable packaging for chainsaws since at least the early 1970's. Such cases provide a useful combination of desirable properties at modest cost. For example, chainsaws are subject to rough handling, and double wall cases offer significant protection from damage through impact. Chainsaws also tend to leak chain lubricating oils during storage, and the base of a double wall case forms a useful drip-pan to retain leaked oil within the confines of the case.

The chain itself contains multiple sharp teeth. As mounted on the bar of the chainsaw, these teeth are exposed and so are subject to dulling if bumped against any hard or abrasive object. More importantly, they are a hazard to articles with which they may come in contact, such as furniture or fingers. Blow molded double wall chainsaw cases now on the market are designed to enclose the bar and chain assembly, thereby isolating the teeth from their surroundings. These cases are generally of either two-piece or three-piece construction. The two-piece case 10A, as shown in FIG. 1, consists of a lid portion 11 and a base portion 12 joined by a hinge 13. The lid portion 11 and the base portion 12, when closed completely, enclose the saw body and attached bar and chain assembly.

The three-piece case 10B, as shown in FIG. 2, consists of double wall lid portion 14 and base portion 15 hinged together, which, when closed, enclose the saw body. The third piece is a separate scabbard 16, preferably of blow molded single wall construction. A section 17 adjacent to the open end of the scabbard 16 fits slideably into a slot 18 molded in the double wall base 15, or into opposing slots molded into both lid 14 and base 15. The sidewalls of the slot or slots 18 hold the scabbard 16 snugly in position in the closed case.

The two-piece case 10A is simple to use in that the saw, with bar assembled to it, can be positioned in the case by lowering it onto a retaining contour in the base of the case, and can be lifted out again for use. The two-piece case 10A is also an effective protector of the saw and chain. However, this type of case has several disadvantages. First, it is relatively bulky, either when shipped empty from the case molder to the saw manufacturer or, with saw enclosed, from the saw producer to a warehouse or a retail sales location. Second, most models of chainsaw are sold with one of a series of different length bars and chains. Therefore, in order to minimize the costs of case tooling and inventory, it is usually necessary to design the case for the longest bar, thereby rendering the case oversized for all others. Also, it is often more convenient for the chainsaw user to leave the case in his/her vehicle or in his/her garage, carrying the saw alone to the work site. In such situations, the impact and leakage protections of the case are relatively unimportant. However, without a scabbard, the teeth of the chain are exposed and therefore subject to being damaged or causing damage.

The three-piece case 10B shown in FIG. 2 overcomes some of these deficiencies. The outside volume of the double wall portion of the case is made smaller. Scabbards of different length can be created at low tooling cost. They take up little space in storage, and may actually be stored for shipping at least partially inside an empty case body. When the saw, with bar and chain assembled, is lifted out of a three-piece case by the end user, the scabbard tends to stay on the bar, to which it is often lightly press fitted. The saw teeth and their surroundings are thereby protected as the saw is carried without the case, and the scabbard is easily slid off the end of the bar when the work site is reached.

However, a number of problems with a three-piece case still remain. First, the display characteristics of the saw installed in a deep double wall base—of either a two- or three-piece case—are severely limited. Second, even the three-piece case is relatively bulky when empty. It can not be nested or shipped flat in sections, and overall length and width of the case is increased by draft angles, necessary to the molding process, extending vertically from the lid and base parting lines. Third, similar blow molding process limitations restrict the designs of two- or three-piece cases to irregular exterior shapes, which must generally follow the outside contours of the saw and assembled bar. Such irregular exterior shapes can not readily be built into stable rectangular groupings or pyramids for palletized shipment or for stacked display in a store. Accordingly, bulky and expensive corrugated cartons must typically be employed to surround the blow molded case and thereby to convert the exterior package shape to that of a rectangular prism. In addition, the irregular shaped case must be secured in position inside the corrugated carton by means of cardboard or plastic support brackets. The combination of case with tapered side walls, plus support brackets, plus outer corrugated box, yields a highly inefficient total package, in that exterior volume is excessive.

What is desired, therefore, is a chainsaw carrying and storage case which allows for good display of the chainsaw in the open case, which is capable of nested shipment when empty, or of being disassembled into relatively flat panels, and which has a shape, when assembled and closed, which allows for stable rectangular groupings or pyramids for palletized shipment or for stacked display in a store.

SUMMARY OF THE INVENTION

Accordingly, it is an object of the present invention to provide a chainsaw case which allows for good display of the chainsaw in the open case.

Another object of the present invention is to provide a chainsaw case having the above characteristics and which is capable of nested shipment when empty, or of being disassembled into relatively flat panels.

A further object of the present invention is to provide a chainsaw case having the above characteristics and which has a shape, when assembled and closed, which allows for stable rectangular groupings or pyramids for palletized shipment or for stacked display in a store.

These and other objects of the present invention are achieved by provision of a chainsaw case for a chainsaw having a bar. The carrying case includes a base having a lower wall, a rear wall, and two end walls, one of the end walls having a slot therein. A front member is pivotally connected to the base about a pivot axis, the front member being pivotable from a closed position toward a position in which the front member is substantially coplanar with the lower wall of the base. A top member is pivotally connected to the base about a pivot axis which is substantially parallel to the pivot axis of the front member, the top member being pivotable from a closed position toward a position in which the top member is substantially coplanar with the rear wall of the base. The case also includes a scabbard for being applied to the bar of the chainsaw, the scabbard having an end portion adapted to be received within the slot in the end wall of the base when the chainsaw, with the scabbard applied thereto, is disposed within the base.

Preferably, the front member is substantially parallel to the rear wall of the base when the front member is in the closed position, the top member is substantially parallel to the lower wall of the base when the top member is in the closed position, and the two end walls of the base are substantially parallel to each other. The rear wall, the lower wall and the two end walls of the base preferably each comprise generally flat double wall panels, and are substantially rigidly joined together to form the base.

Also, the rear wall and the lower wall are preferably connected to each other by a living hinge by which the rear wall and the lower wall may be folded from a position in which the rear wall and the lower wall are substantially coplanar to a position in which the rear wall and the lower wall are substantially perpendicular to each other.

It is also preferable that the front member is pivotally connected to the base by a hinge joining the front member to the lower wall of the base, and that the top member is pivotally connected to the base by a hinge joining the top member to the rear wall of the base. The carrying case preferably further includes at least one latch for releasably joining the front member to the top member when in the closed position.

In one embodiment, the slot is formed in one of the end walls of the base along an edge of the end wall adjacent to the front member when the front member is in the closed position, such that the end portion of the scabbard is inserted into the slot as the scabbard is moved from the front toward the rear wall of the base. In another embodiment, the slot is formed in one of the end walls of the base along an edge of the end wall adjacent to the top member when the top member is in the closed position, such that the end portion of the scabbard is inserted into the slot as the scabbard is moved downward toward the lower wall of the base. In this embodiment, a door for closing at least a portion of the slot is preferably provided. Most preferably, the door is pivotally connected to the end wall of the base in which the slot is formed.

The invention and its particular features and advantages will become more apparent from the following detailed description considered with reference to the accompanying drawings.

DETAILED DESCRIPTION OF THE INVENTION

Figure 1:
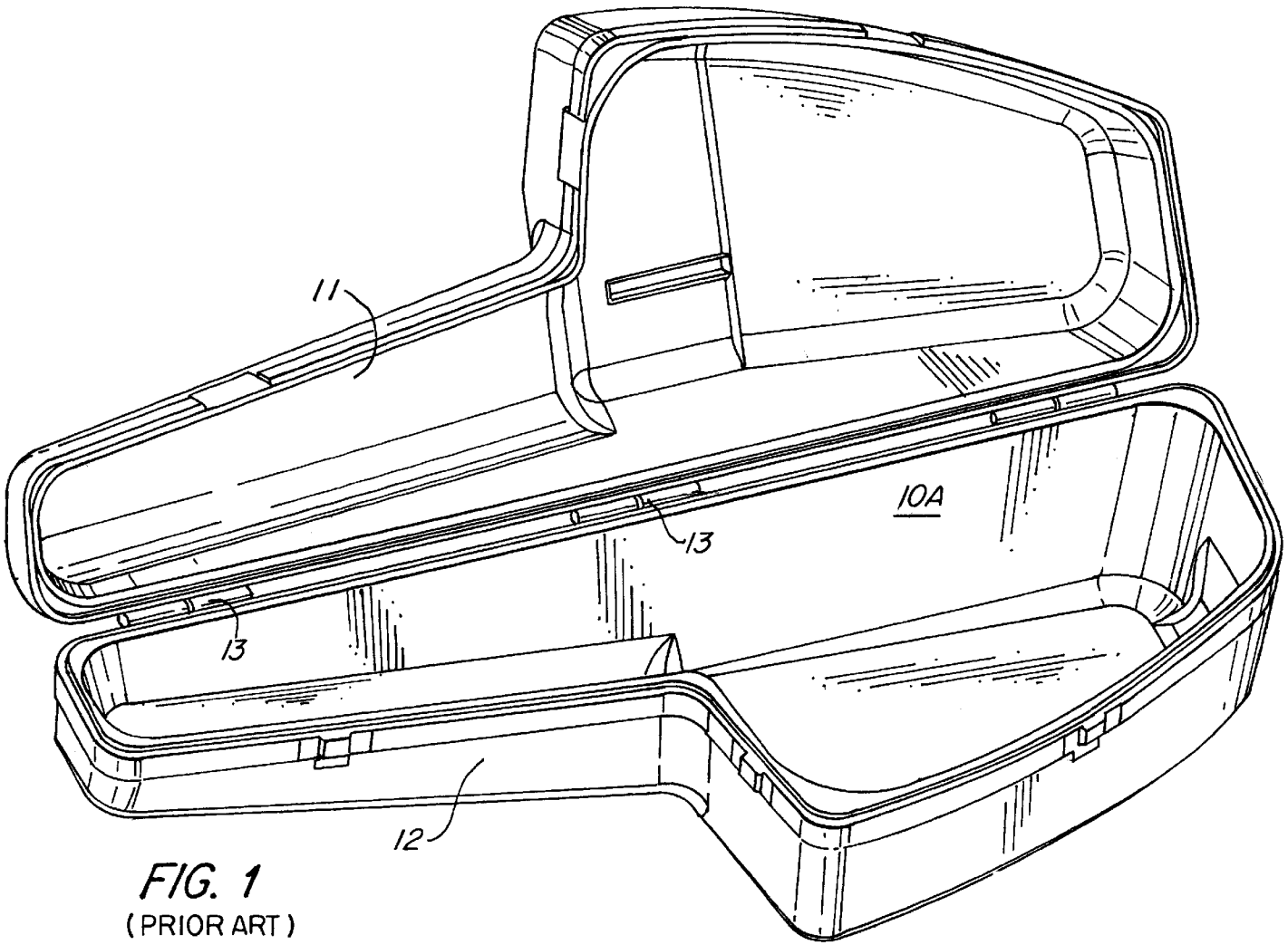
FIG. 1 (PRIOR ART)
FIG. 1 is a perspective view of a prior art two-piece chainsaw carrying and storage case.
Figure 2:
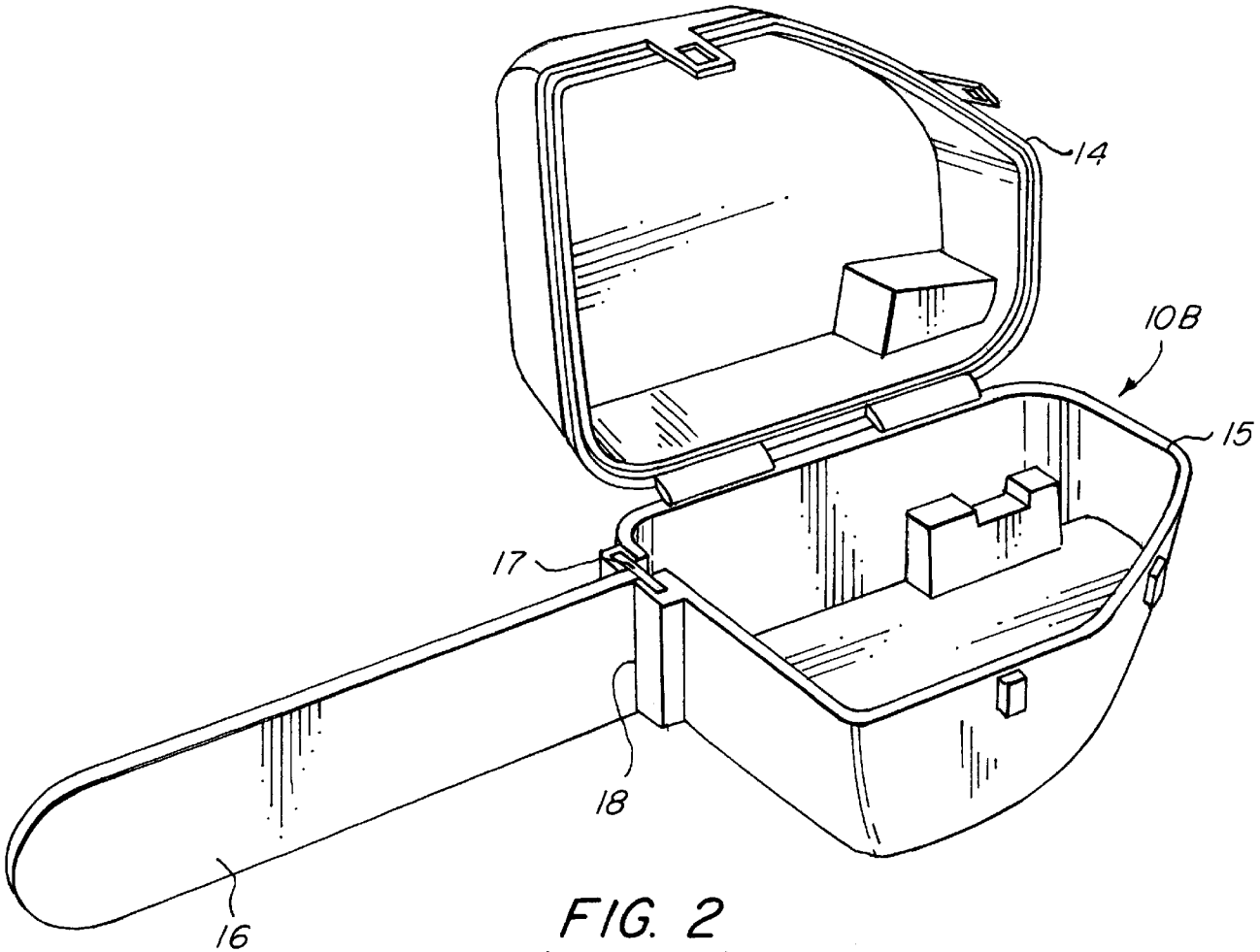
FIG. 2 (PRIOR ART)
FIG. 2 is a perspective view of a prior art three-piece chainsaw carrying and storage case.
Figure 3:
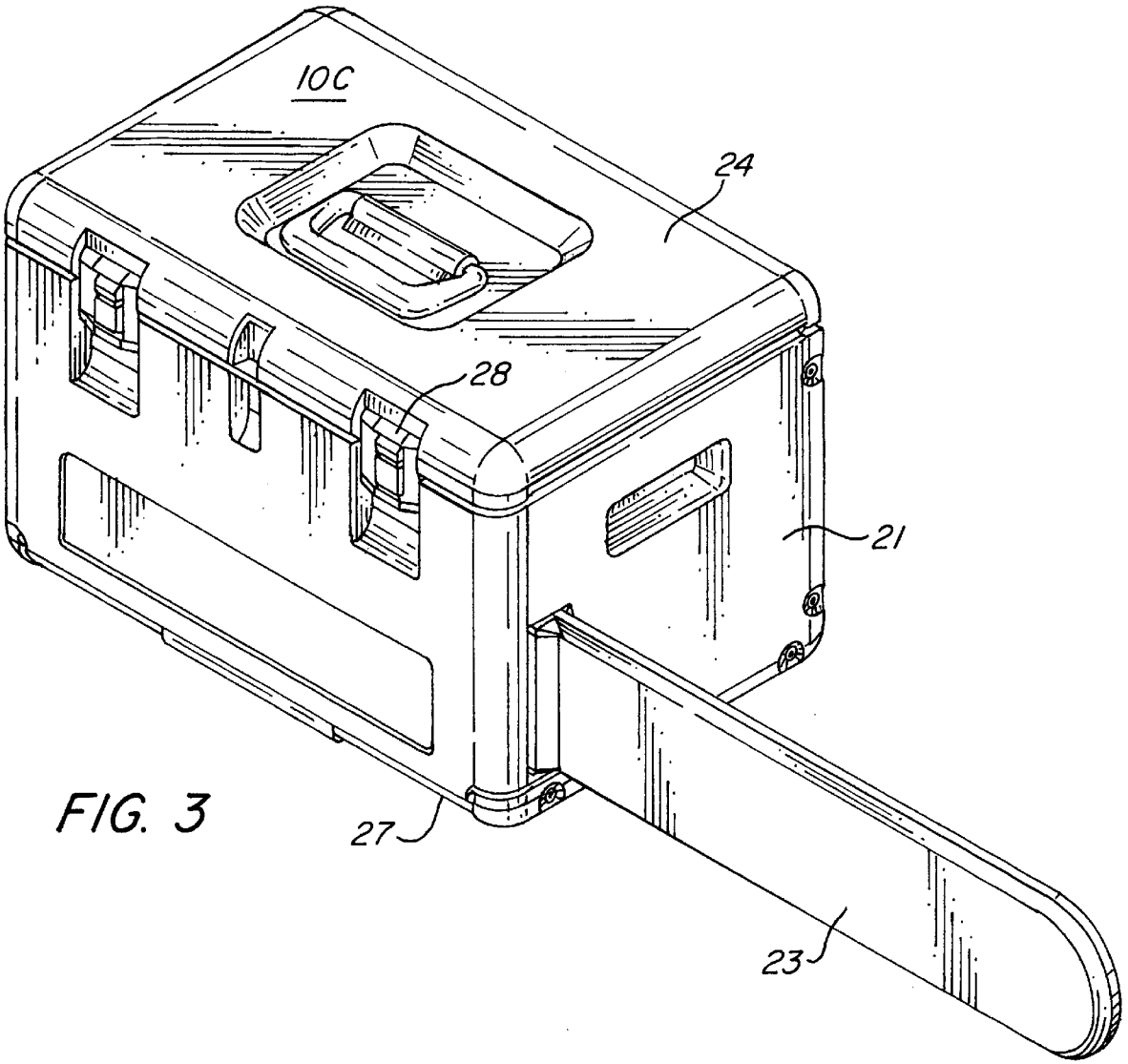
FIG. 3 is a perspective view of a chainsaw carrying and storage case in accordance with one embodiment of the present invention.
Figure 4:
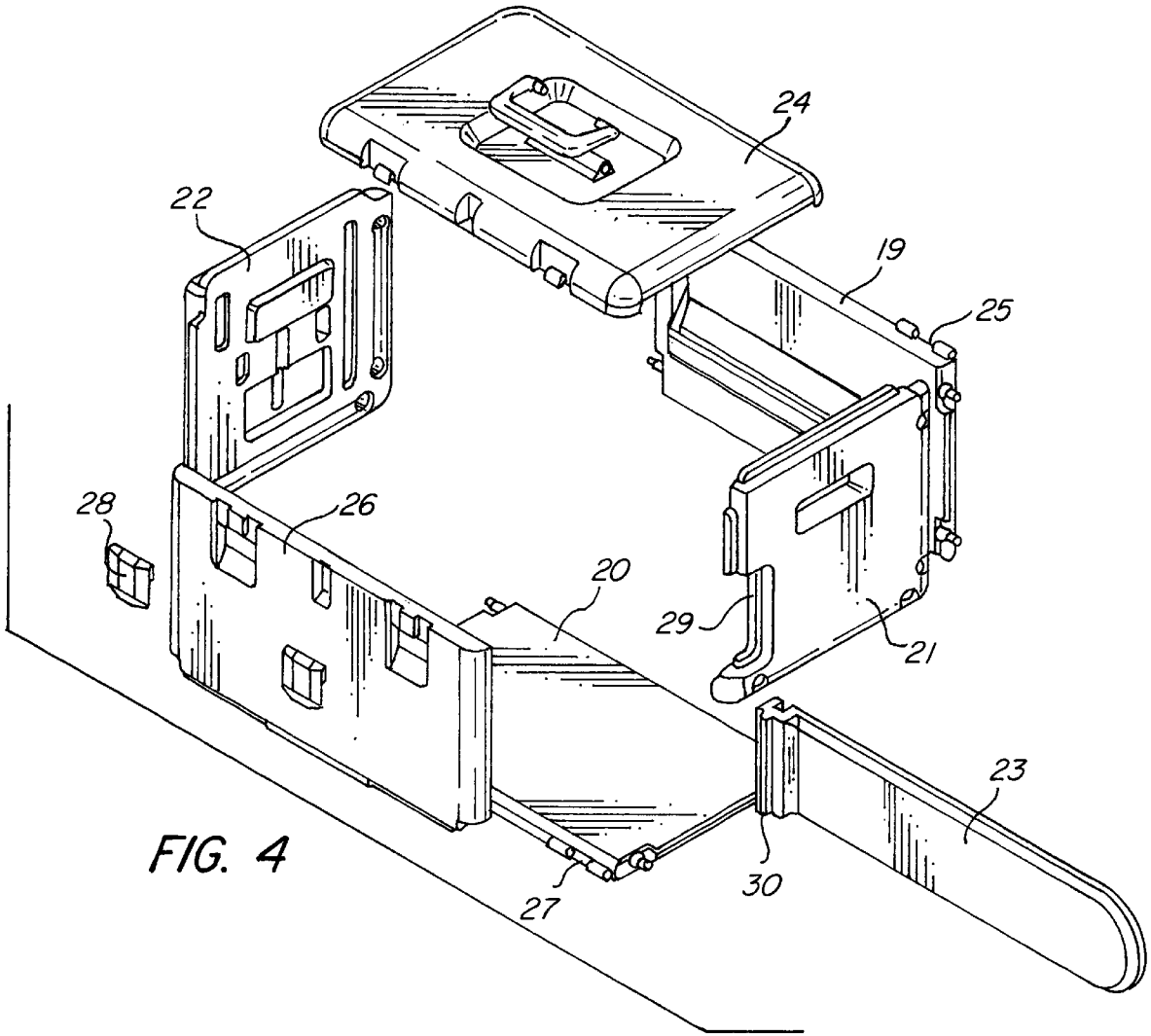
FIG. 4 is an exploded perspective view of the chainsaw carrying and storage case shown in FIG. 3.

Referring now to FIGS. 3 and 4, one case 10C in accordance with the present invention is shown. As best seen in FIG. 4, case 10C is comprised of seven main components. Four of these components, the rear panel 19, the bottom panel 20, the right end panel 21, and the left end panel 22, are assembled in a substantially fixed relationship with respect to each other. The fifth component of the case 10C is a removable scabbard 23, while its last two main components are doors. Top door 24 lies generally horizontally on top of the closed case and pivots around a hinge 25 located generally along the top rear edge of the case. Front door 26 is positioned generally vertically on the front face of the closed case and pivots to a generally horizontal open position, co-planar with the bottom panel 20, around a hinge 27 located generally along the bottom edge of the front face of the case. In the closed position of the case, top and front doors are connected and secured by latch means 28.

Figure 4A:
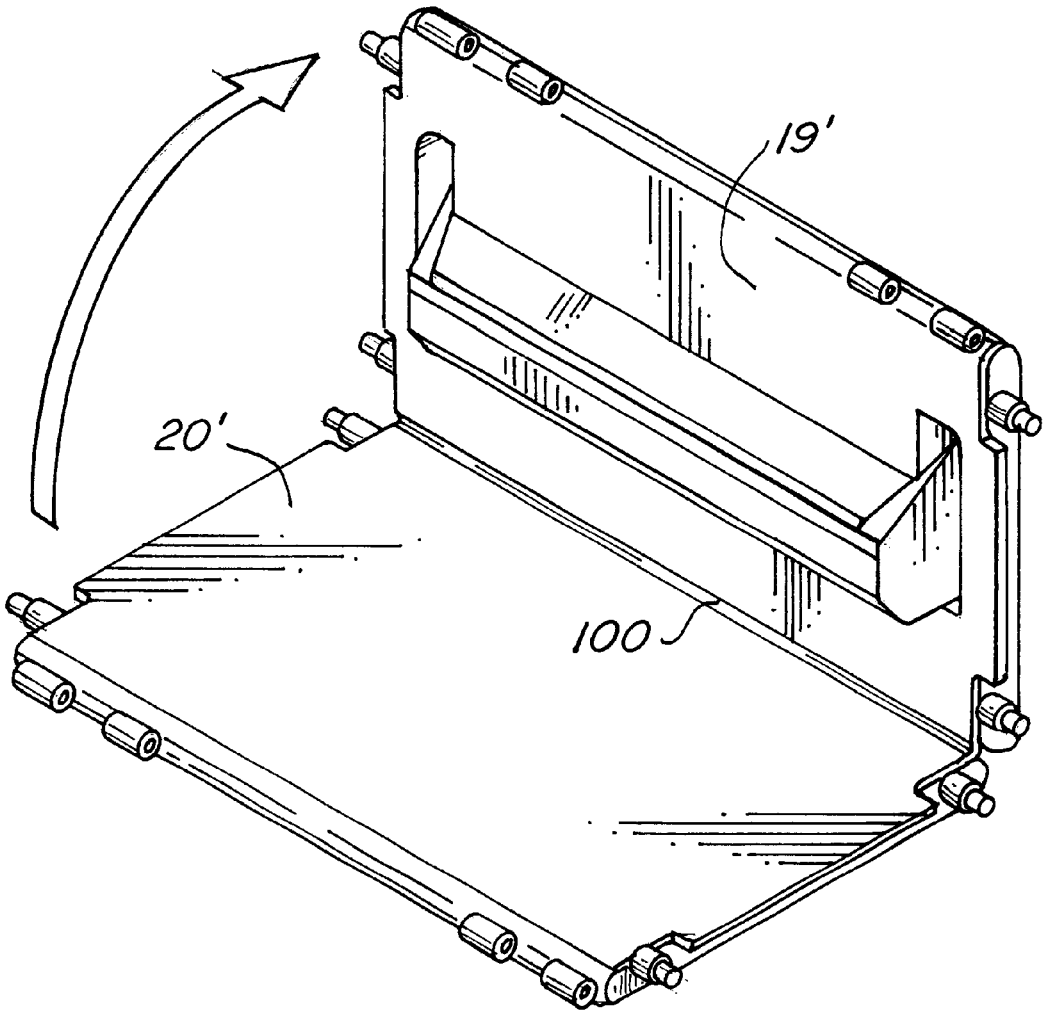
FIG. 4A is a perspective view of an alternative embodiment of a portion of the chainsaw carrying and storage case shown in FIG. 4.

As shown in FIG. 4, the rear panel 19 and the bottom panel 20 may comprise two separate panels, or as shown in FIG. 4A, the rear panel 19' and the bottom panel 20' may be joined by a living hinge 100. Such a living hinge configuration may be desirable in that it allows the rear panel 19' and the bottom panel 20' to be folded down to a substantially coplanar configuration to facilitate shipping, and to be folded up to a position where the panels are substantially perpendicular to facilitate assembly and provide greater structural integrity.

FIG. 4 also shows the mounting area 29 for the scabbard 23 in the base of the case, and of the configuration of that portion 30 of the scabbard 23 which mounts therein. By visualizing the front door 26 in its open, horizontal position, it becomes readily apparent that the saw, with scabbard 23 attached, may be easily slid in and out of its mounting position in the case 10C, in substantially horizontal front to back and back to front manners respectively. It should also be apparent that the open case provides excellent display of the saw in it.

The case 10C described above is constructed by joining together a series of essentially flat double wall panels. The blow molding and assembly of double wall blow molded panels is well known and need not be further described herein. There are at least two major advantages of such a construction. First, the case components can be shipped, partially joined into flat sub-assemblies, from the case molder to the saw manufacturer, thereby saving shipping and storage space; the saw manufacturer completes the assembly of the case as part of its saw packaging line. Second, the case 10C itself is an efficient total package. It has generally straight side walls, thereby eliminating the waste space inherent in drafted side walls. Moreover, it is generally rectangular, thereby eliminating the need for spacer brackets inside an outer case and for the outer case itself. At most, the case 10C of the present invention may require as exterior packaging only a thin and inexpensive chipboard sleeve for advertising display.

As seen in FIGS. 3 and 4, the scabbard 23, and therefore the chainsaw bar and chain, are positioned at the right front side (i.e., the latch side) of the case 10C. The scabbard 23 is held in the closed case between the edge of the right end panel 21 and the lower right inner surface of the vertical door 26. This provides for easy removal of the saw, with scabbard 23 attached, generally horizontally towards the front of the open case 10C.

Figure 5:
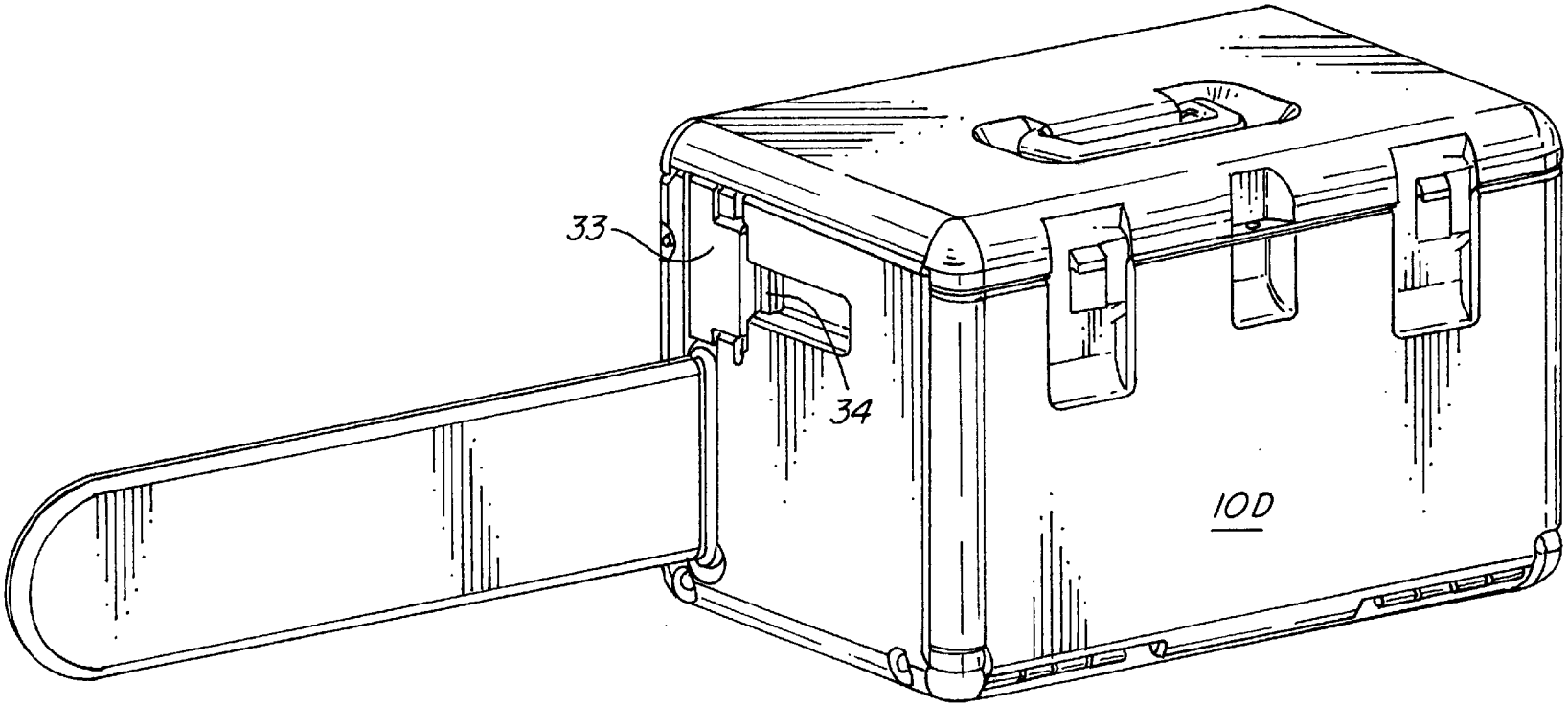
FIG. 5 is a perspective view of a chainsaw carrying and storage case in accordance with another embodiment of the present invention.
Figure 6:
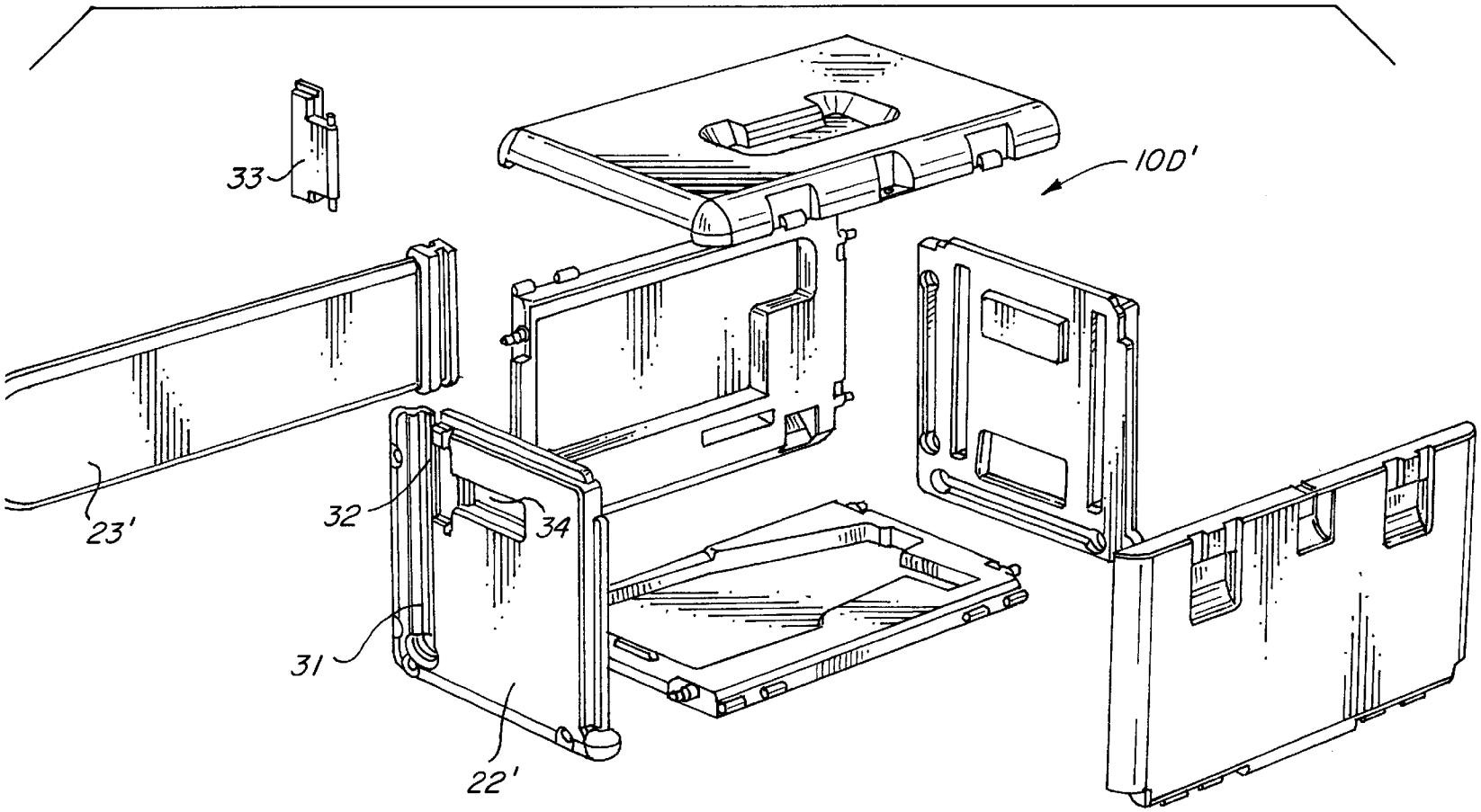
FIG. 6 is an exploded perspective view of the chainsaw carrying and storage case shown in FIG. 5.

However, certain chainsaw manufacturers may prefer a package orientation whereby the scabbard protrudes from the rear of the left end panel rather than the front of the right end panel. A case 10D accommodating this saw orientation is shown in FIGS. 5 and 6. When this design is used, it becomes necessary to mold a deep slot 31 at the rear of the left end panel 22', in order to slide the scabbard 23', which protrudes from the lower portion of the saw body, into position to permit the case 10D to be closed around the saw body. This slot creates an opening 32 at the top portion of the left end panel 22', which opening may be covered by a hinged or slideable door 33. This door 33 may be made less obtrusive by combining its design with one end of recessed handle grip 34.

It will be seen that the present invention is in no way limited to the two embodiments illustrated, and the particular arrangement of parts and features herein described are not intended to exhaust all possible arrangements of parts and features. For example, one or more of the doors or panels of the case body may be of single wall construction and may be produced by injection molding or other forming technique, using either plastic or non-plastic materials. Indeed, many other modifications and variations will be ascertainable to those skilled in the art.

The present invention, therefore, provides a chainsaw carrying and storage case which allows for good display of the chainsaw in the open case, which is capable of nested shipment when empty, or of being disassembled into relatively flat panels, and which has a shape, when assembled and closed, which allows for stable rectangular groupings or pyramids for palletized shipment or for stacked display in a store.

What is claimed is:

1. A carrying case for a chainsaw having a bar, said carrying case comprising:

a base having a lower wall, a rear wall, and two end walls, one of the end walls having a slot therein;

a front member pivotally connected to said base about a pivot axis, said front member being pivotable from a closed position toward a position in which said front member is substantially coplanar with the lower wall of said base;

a top member pivotally connected to said base about a pivot axis which is substantially parallel to the pivot axis of said front member, said top member being pivotable from a closed position toward a position in which said top member is substantially coplanar with the rear wall of said base;

a scabbard for being applied to the bar of the chainsaw, said scabbard having an end portion adapted to be received within the slot in the end wall of said base when the chainsaw, with said scabbard applied thereto, is disposed within said base; and wherein the rear wall, the lower wall and the two end walls of said base are substantially rigidly joined together to form said base such that said base comprises a substantially rigid structure.

2. The carrying case of claim 1 wherein said front member is substantially parallel to the rear wall of said base when said front member is in the closed position, wherein said top member is substantially parallel to the lower wall of said base when said top member is in the closed position, and wherein said two end walls of said base are substantially parallel to each other.

3. The carrying case of claim 1 wherein the rear wall, the lower wall and the two end walls of said base each comprise generally flat double wall panels.

4. The carrying case of claim 1 wherein the rear wall and the lower wall are connected to each other by a hinge by which the rear wall and the lower wall may be folded from a position in which the rear wall and the lower wall are substantially coplanar to a position in which the rear wall and the lower wall are substantially perpendicular to each other.

5. The carrying case of claim 1 wherein said front member is pivotally connected to said base by a hinge joining said front member to the lower wall of said base.

6. The carrying case of claim 1 wherein said top member is pivotally connected to said base by a hinge joining said top member to the rear wall of said base.

7. The carrying case of claim 1 further comprising at least one latch for releasably joining said front member to said top member when in the closed position.

8. The carrying case of claim 1 wherein the slot is formed in one of the end walls of said base along an edge of the end wall adjacent to said front member when said front member is in the closed position, such that the end portion of the scabbard is inserted into the slot as the scabbard is moved from the front toward the rear wall of said base.

9. The carrying case of claim 1 wherein the slot is formed in one of the end walls of said base along an edge of the end wall adjacent to said top member when said top member is in the closed position, such that the end portion of the scabbard is inserted into the slot as the scabbard is moved downward toward the lower wall of said base.

10. The carrying case of claim 9 further comprising a door for closing at least a portion of the slot.

11. The carrying case of claim 10 wherein the door is pivotally connected to the end wall of said base in which the slot is formed.

12. A carrying case for a chainsaw having a bar, said carrying case comprising:

a base having a lower wall, a rear wall, and two end walls, each comprising a generally flat double wall panel, which are substantially rigidly joined together to form said base such that said base comprises a substantially rigid structure once the lower wall, the rear wall and the two end walls are joined together, one of the end walls having a slot therein, the end walls being substantially parallel to each other;

a hinge connecting the rear wall and the lower wall by which, before the lower wall, the rear wall and the two end walls are joined together, the rear wall and the lower wall may be folded from a position in which the rear wall and the lower wall are substantially coplanar to a position in which the rear wall and the lower wall are substantially perpendicular to each other;

a front member pivotally connected, about a pivot axis, to the lower wall of said base, said front member being pivotable from a closed position toward a position in which said front member is substantially coplanar with the lower wall of said base, said front member being substantially parallel to the rear wall of said base when said front member is in the closed position;

a top member pivotally connected, about a pivot axis which is substantially parallel to the pivot axis of said front member, to the rear wall of said base, said top member being pivotable from a closed position toward a position in which said top member is substantially coplanar with the rear wall of said base, said top member being substantially parallel to the lower wall of said base when said top member is in the closed position;

a scabbard for being applied to the bar of the chainsaw, said scabbard having an end portion adapted to be received within the slot in the end wall of said base when the chainsaw, with said scabbard applied thereto, is disposed within said base; and at least one latch for releasably joining said front member to said top member when in the closed position.

13. The carrying case of claim 12 wherein the slot is formed in one of the end walls of said base along an edge of the end wall adjacent to said front member when said front member is in the closed position, such that the end portion of the scabbard is inserted into the slot as the scabbard is moved from the front toward the rear wall of said base.

14. The carrying case of claim 12 wherein the slot is formed in one of the end walls of said base along an edge of the end wall adjacent to said top member when said top member is in the closed position, such that the end portion of the scabbard is inserted into the slot as the scabbard is moved downward toward the lower wall of said base.

15. The carrying case of claim 14 further comprising a door for closing at least a portion of the slot.

16. The carrying case of claim 15 wherein the door is pivotally connected to the end wall of said base in which the slot is formed.

17. A carrying case for a chainsaw having a bar, said carrying case comprising:

a base having a lower wall, a rear wall, and two end walls, one of the end walls having a slot therein;

a front member pivotally connected to said base about a pivot axis, said front member being pivotable from a closed position toward a position in which said front member is substantially coplanar with the lower wall of said base;

a top member pivotally connected to said base about a pivot axis which is substantially parallel to the pivot axis of said front member, said top member being pivotable from a closed position toward a position in which said top member is substantially coplanar with the rear wall of said base;

a scabbard for being applied to the bar of the chainsaw, said scabbard having an end portion adapted to be received within the slot in the end wall of said base when the chainsaw, with said scabbard applied thereto, is disposed within said base;

wherein the slot is formed in one of the end walls of said base along an edge of the end wall adjacent to said front member when said front member is in the closed position, such that the end portion of the scabbard is inserted into the slot as the scabbard is moved from the front toward the rear wall of said base; and wherein the rear wall, the lower wall and the two end walls of said base are substantially rigidly joined together to form said base such that said base comprises a substantially rigid structure.

18. The carrying case of claim 17 wherein said front member is substantially parallel to the rear wall of said base when said front member is in the closed position, wherein said top member is substantially parallel to the lower wall of said base when said top member is in the closed position, and wherein said two end walls of said base are substantially parallel to each other.

19. The carrying case of claim 17 wherein the rear wall, the lower wall and the two end walls of said base each comprise generally flat double wall panels.

20. The carrying case of claim 17 wherein the rear wall and the lower wall are connected to each other by a living hinge by which the rear wall and the lower wall may be folded from a position in which the rear wall and the lower wall are substantially coplanar to a position in which the rear wall and the lower wall are substantially perpendicular to each other.

21. The carrying case of claim 17 wherein said front member is pivotally connected to said base by a hinge joining said front member to the lower wall of said base.

22. The carrying case of claim 17 wherein said top member is pivotally connected to said base by a hinge joining said top member to the rear wall of said base.

23. The carrying case of claim 17 further comprising at least one latch for releasably joining said front member to said top member when in the closed position.

* * * * *